US006712231B1

(12) United States Patent
Ernst et al.

(10) Patent No.: US 6,712,231 B1
(45) Date of Patent: Mar. 30, 2004

(54) COUPLING ARRANGEMENT FOR RAIL VEHICLES

(75) Inventors: Dieter F. Ernst, Wuppertal (DE); Lennart Wikström, Västerås (SE); Svante Lennartsson, Falun (SE)

(73) Assignee: Dellner Couplers AB, Falun (SE)

( * ) Notice: Subject to any disclaimer, the term of this patent is extended or adjusted under 35 U.S.C. 154(b) by 0 days.

(21) Appl. No.: 10/129,542

(22) PCT Filed: Nov. 6, 2000

(86) PCT No.: PCT/SE00/02167

§ 371 (c)(1),
(2), (4) Date: May 30, 2002

(87) PCT Pub. No.: WO01/34448

PCT Pub. Date: May 17, 2001

(30) Foreign Application Priority Data

Nov. 8, 1999 (SE) ..... 9904030

(51) Int. Cl.[7] ..... B61G 3/00
(52) U.S. Cl. ..... 213/75 R; 213/77
(58) Field of Search ..... 213/75 R, 76, 213/77, 79, 196, 208, 211

(56) References Cited

U.S. PATENT DOCUMENTS 4,391,380 A * 7/1983 Hoose ..... 213/76
4,763,875 A * 8/1988 Chew ..... 251/149.9

FOREIGN PATENT DOCUMENTS

| | | | | |
|---|---|---|---|---|
| DE | 2110957 | | 9/1972 | |
| DE | 19647096 | | 5/1998 | |
| DE | 196 47 906 | * | 5/1998 | ..... B61G/5/10 |
| GB | 1247128 | | 9/1971 | |

* cited by examiner

*Primary Examiner*—Stephen Avila
*Assistant Examiner*—Robert J. McCarry, Jr.
(74) *Attorney, Agent, or Firm*—Dykema Gossett PLLC

(57) ABSTRACT

A coupling arrangement for coupling together rail vehicles such as railway carriages and locomotives consisting of a coupling head comprising a coupling housing (1) joined to the rail vehicle and having an active coupling device in the form of a plunger (2) movable between an outer and an inner position and designed to co-operate with a similar plunger in a corresponding coupling head when two coupling heads are coupled together, the plungers (2) being movable in directions that are substantially perpendicular to the longitudinal directions of the coupling heads and can be released at uncoupling. A locking device (7) is provided in the coupling arrangement and comprises a locking member (7.5) arranged to be brought into contact with the plunger (2) when this is in its outer position and to prevent the plunger (2) being displaced from this position.

8 Claims, 4 Drawing Sheets

COUPLING ARRANGEMENT FOR RAIL VEHICLES

TECHNICAL FIELD

The present invention relates to a coupling arrangement for coupling together rail vehicles such as railway carriages and locomotives, consisting of a coupling head comprising a coupling housing joined to the rail vehicle and having an active coupling device in the form of a plunger movable between an outer and an inner position and designed to co-operate with a similar plunger in a corresponding coupling head when two coupling heads are coupled together.

BACKGROUND ART

In automatic coupling of rail vehicles such as railway carriages, locomotives and the like, coupling arrangements are used that permit carriages, etc. to be coupled together regardless of which end of the carriage is facing the carriage with which it is to be coupled. Such coupling arrangements comprise a coupling housing connected to the rail vehicle and having an active coupling member in the form of a plunger designed to co-operate with a similar plunger in a corresponding coupling head when these are coupled together. Each plunger has a surface that is inclined to the longitudinal direction of the coupling head and a load-absorbing contact surface perpendicular to this direction. When the two coupling heads are united, the inclined surfaces are brought into contact with each other, whereupon the plungers are displaced in opposite directions until the two contact surfaces have been aligned so that the plungers can return and be brought into engagement with each other. Such a coupling arrangement is manufactured by SAB WABCO BSI Verkehrstechnic GmbH, Germany.

The disadvantage with the known coupling arrangement is that, after some time in use, the load-absorbing contact surfaces of the plunger, as well as other components in the coupling head, become worn. Railway tracks are usually not so smooth that carriages and locomotives can be driven along them without vibration and twisting, which subject the coupling heads to considerable strain. It has been found that coupling heads that have been subjected to a certain amount of wear lose their load-transmitting function when subjected to such strain, i.e. the plungers lose their grip on each other. The connection between carriages or between carriage and locomotive is consequently broken and the train unit is automatically braked and comes to a standstill. Other reasons for such coupling heads losing their function are that the spring retaining the plunger in engagement position breaks or becomes fatigued, or that two plungers do not achieve correct engagement with each other. Since this type of automatic coupling arrangement is widely used, a great need exists to improve its function as regards ensuring that the coupling heads do not unintentionally separate during use.

SUMMARY OF THE INVENTION

The object of the present invention is to provide a coupling arrangement that does not have the drawbacks of the existing coupling arrangement described above. The object is achieved with a coupling arrangement consisting of a coupling head comprising a coupling housing joined to the rail vehicle and having an active coupling device in the form of a plunger movable between an outer and an inner position and designed to cooperate with a similar plunger in a corresponding coupling head when two coupling heads are coupled together. The plungers are movable in directions that are substantially perpendicular to the longitudinal directions of the coupling heads and can be moved away from each other by mutual contact at interlocking, and with the aid of a disengaging means for each plunger when a train unit is being uncoupled.

To prevent the plungers being unintentionally separated when their contact surfaces have become worn to a certain extent, or when rupture or fatigue occurs in the plunger springs, a locking device is provided in each coupling arrangement and comprises a locking member arranged to be brought into contact with the plunger when this is in its outer position and to prevent the plunger being displaced from this position.

In a preferred embodiment of the invention the locking arrangement is provided with a toggle joint comprising two locking links which are hingeably joined and placed in a locking housing and which, when the plunger is in locked position, are aligned in one and the same plane, the outer part of one link resting against the locking housing and the outer part of the other link resting against the locking member, thus transmitting a force between the locking member and the locking housing. The locking links can be turned in relation to each other and folded about a hinge so that their outer ends are moved towards each other. When the locking links are folded in this manner their force-transmitting influence on the locking member ceases and the latter can therefore be disengaged from its contact with the plunger so that this is released.

The locking member may consist of a roller which, upon locking, is displaced directly or indirectly at right angles to its longitudinal direction in a channel in the locking housing in a direction towards the plunger to engage with a corresponding recess in its outer shell.

With the object of being able to operate the locking arrangement between locked and disengaged position an actuating rod is arranged to extend through the locking arrangement and is connected to the locking links. One end of the actuating rod is connected to a piston in an operating cylinder which, when pressurised by means of a hydraulic or pneumatic pressure medium, causes the locking links to press the locking member to engagement with the plunger.

However, the invention is not limited to a locking arrangement comprising a toggle joint and many embodiments are feasible instead.

In a first alternative embodiment of the locking arrangement in accordance with the invention, the locking member may be influenced by a linearly movable wedge, which, upon contact, presses the locking member against the plunger. The wedge is connected to an actuating rod of the type described above.

In a second alternative embodiment of the locking arrangement in accordance with the invention the locking member may consist of a rod activated by a servo device e.g. a compressed air cylinder, with the aid of which the rod can be inserted into a hole in the plunger when this is in its outer position, thereby locking the plunger against undesired depression. The servo device is only activated after connection has been performed so that the rod engages with the plunger. The rod may be spring-loaded and returns to its original position as soon as the servo device is disconnected. Alternatively the rod may be spring-loaded in the starting position and automatically engage with the plunger when this is pressed in, and is disengaged with the aid of the servo device.

In a third alternative embodiment of the locking arrangement in accordance with the invention the locking member may consist of a latch that can be turned between a disengaged position in which the plunger is freely movable, and a locked position in which the latch is in communication with a recess in the plunger. The latch can be actuated by a servo device in the same way as for the rod as mentioned above.

In a fourth alternative embodiment of the locking arrangement in accordance with the invention the locking member may consist of a turnable rod that extends through a recess in the shell of the plunger, the rod having a recess extending to its centre. When the rod is turned so that its recess is directed towards the plunger the latter can move freely, but when the rod is turned so that its solid part is in communication with the recess in the plunger the latter is locked. This turnable rod can be actuated by a servo device.

Additional alternative solutions as regards the design of the locking arrangement are feasible within the scope of the invention, which relates to all forms of locking members that can be brought into contact with and firmly retain the plunger when this is in its outer position, and prevent the plunger, due to wear, broken or fatigued springs and the like, releasing its grip on the plunger in the corresponding coupling head. The choice of solution as regards the locking member is determined to a certain extent by the design of the rest of the coupling arrangement and how much space is available for the locking arrangement, which in turn is determined by the demands placed on its function.

Additional details and features pertaining to the preferred embodiment of the invention are revealed in the description of the drawings and also in the claims.

BRIEF DESCRIPTION OF THE DRAWINGS

One embodiment of the invention is described in the following by way of example with reference to the accompanying drawings.

DETAILED DESCRIPTION OF THE PREFERRED EMBODIMENT

Figure 1:
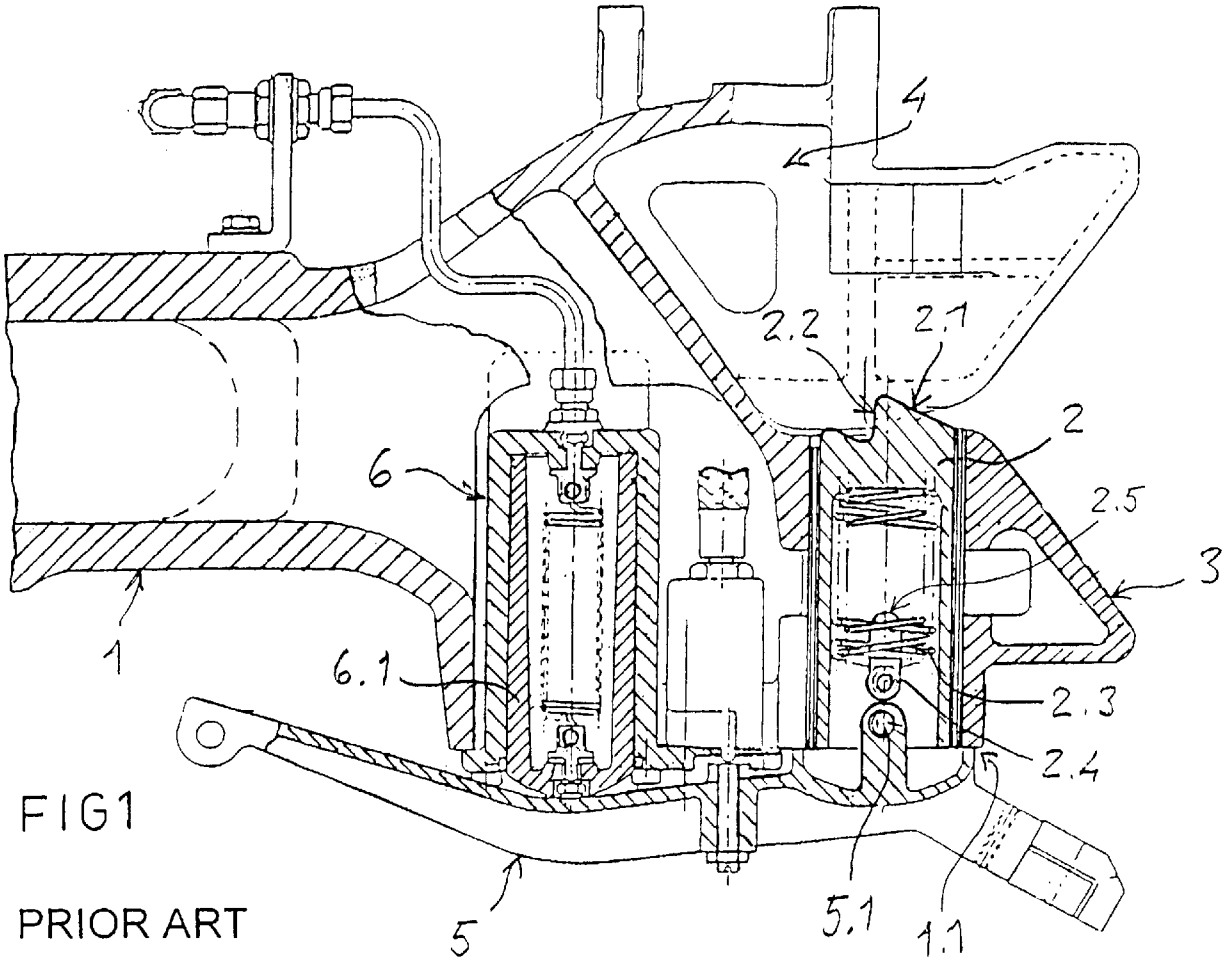
FIG1 PRIOR ART
FIG. 1 shows a coupling arrangement in accordance with known technology, in a horizontal section, which has not been modified in accordance with the present invention.

The coupling arrangement shown in FIG. 1 is manufactured by SAB WABCO BSI Verkehrstechnic GmbH, Germany, and is generally used for automatic coupling of rail vehicles such as railway carriages and locomotives. The coupling arrangement consists of a coupling head comprising a coupling housing 1 joined to the rail vehicle, not shown in the figure, and having an active coupling device in the form of a plunger 2 designed to co-operate with a similar plunger in a corresponding coupling head when these are coupled together. The plunger 2 is tubular and has a closed outer end with a hook-shaped part having coupling surfaces consisting of a surface 2.1 inclined to the longitudinal direction of the coupling head and a load-absorbing contact surface 2.2 perpendicular to this direction. The plunger 2 is held by spring force, pressed in towards the center of the coupling head by means of a helical spring 2.3 arranged inside the plunger 2. At the front end of the coupling housing 1 is a forwardly protruding nose-shaped member 3 designed to engage with a corresponding recess 4 when two coupling heads are coupled together. The spring 2.3 in the plunger 2 rests partly against the closed end of the plunger 2 with its coupling surfaces 2.1, 2.2 and also against a pin 2.4 which extends down through the plunger 2 in oblong grooves 2.5 in its envelope or shell surface, and which is secured in the coupling housing 1 on each side of the plunger 2.

When two coupling heads are united, the nose member 3 rests against inner support surfaces in the recess 4 while the inclined surfaces 2.1 in the two co-operating plungers 2 are brought into contact with each other. The plungers are thus displaced outwardly from the centre of the coupling head until the two contact surfaces 2.2 have been aligned so that the plungers 2 can return and be brought into engagement with each other.

Two united coupling heads are disengaged from each other by at least one of the plungers 2 being pulled out of contact with the other by means of a disengaging lever 5 which is hinged to the plunger via a pin 5.1, one end resting against a counter-support 1.1 on the coupling head 1. The disengaging lever 5 is influenced at one end by a pneumatic disengaging cylinder 6 having a piston 6.1 which, when the cylinder 6 is placed under pressure, protrudes and turns the disengaging lever 5 about the counter-support 1.1 which thus pulls in the plunger 2 against the force of the spring 2.3 therein.

Figure 2:
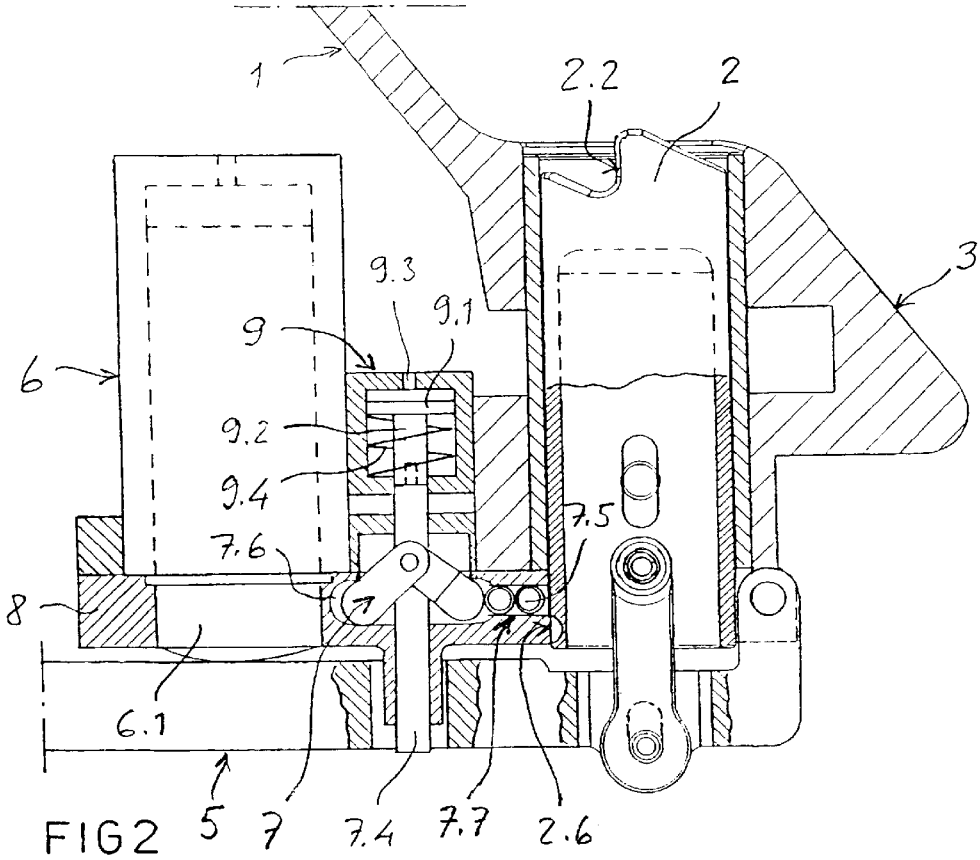
FIG. 2 shows schematically, also in a horizontal section, the active coupling parts in a coupling arrangement in disengaged position, the coupling arrangement having been modified in accordance with the invention.

The coupling arrangement in accordance with the invention, shown in FIG. 2, has substantially the same function as the known arrangement shown in FIG. 1 and, like this, comprises a coupling housing 1 that houses an active coupling member in the form of a plunger 2 designed to co-operate with a similar plunger in a corresponding coupling head. FIG. 2 shows the plunger 2 in its inner position, i.e. at the moment when two co-operating plungers are just about to pass each other in a coupling stage between two coupling heads. In the position shown in FIG. 2 the locking arrangement 7 is not activated and the plunger 2 can therefore move freely in its bore. The coupling arrangement in accordance with the invention is provided with a locking device 7 designed to lock the plunger 2 in its outer position, as shown in FIG. 3, i.e. when two coupling heads are coupled together to transmit a tensile force between the contact surfaces 2.2 of the plungers.

Figure 4:
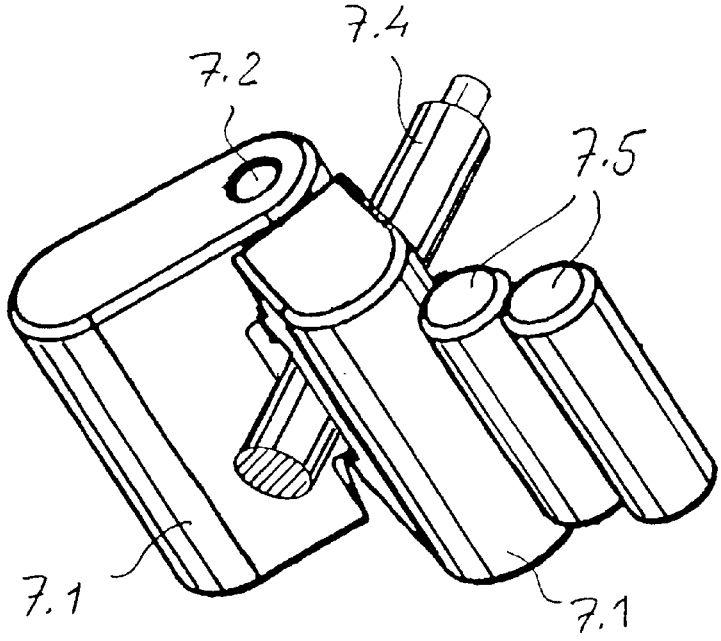
FIG. 4 shows a locking link on its own, in the position shown in FIG. 2.

The active parts of the locking device 7 are shown separately in FIG. 4 and consist of a toggle joint comprising two locking links 7.1 which are joined by a linking pin 7.2 and hingeable in relation to each other so that the locking links 7.1 can be folded about a hinge. The exterior of each locking link 7.1 has a semicylindrical outer part and its inner part has two pairs of lugs 7.3 which co-operate via the through-running link pin 7.2. An actuating rod 7.4 is arranged between the locking links 7.1 and has a hole through which the link pin 7.2 passes. This hole is preferably oblong and extends perpendicularly to the longitudinal direction of the actuating rod 7.4 to prevent the force between the locking links 7.1 being transmitted to the actuating rod 7.4 which would otherwise tend to jam against the link pin 7.2 and become difficult to move. The locking links 7.1 are housed in a recess 7.6 in a housing 8 where the recess 7.6 has an appearance corresponding to the position of the locking links 7.1 shown in FIG. 5, which allows the locking links 7.1 to be folded about their joint so that their outer parts approach each other in the recess 7.6. One of the locking links 7.1 is in contact with a pair of locking rollers 7.5 which are movable at right angles to their longitudinal direction in a channel 7.7 in the locking housing 8 and which constitute the active member that is brought into contact with the plunger 2 when this is locked fast.

Figure 3:
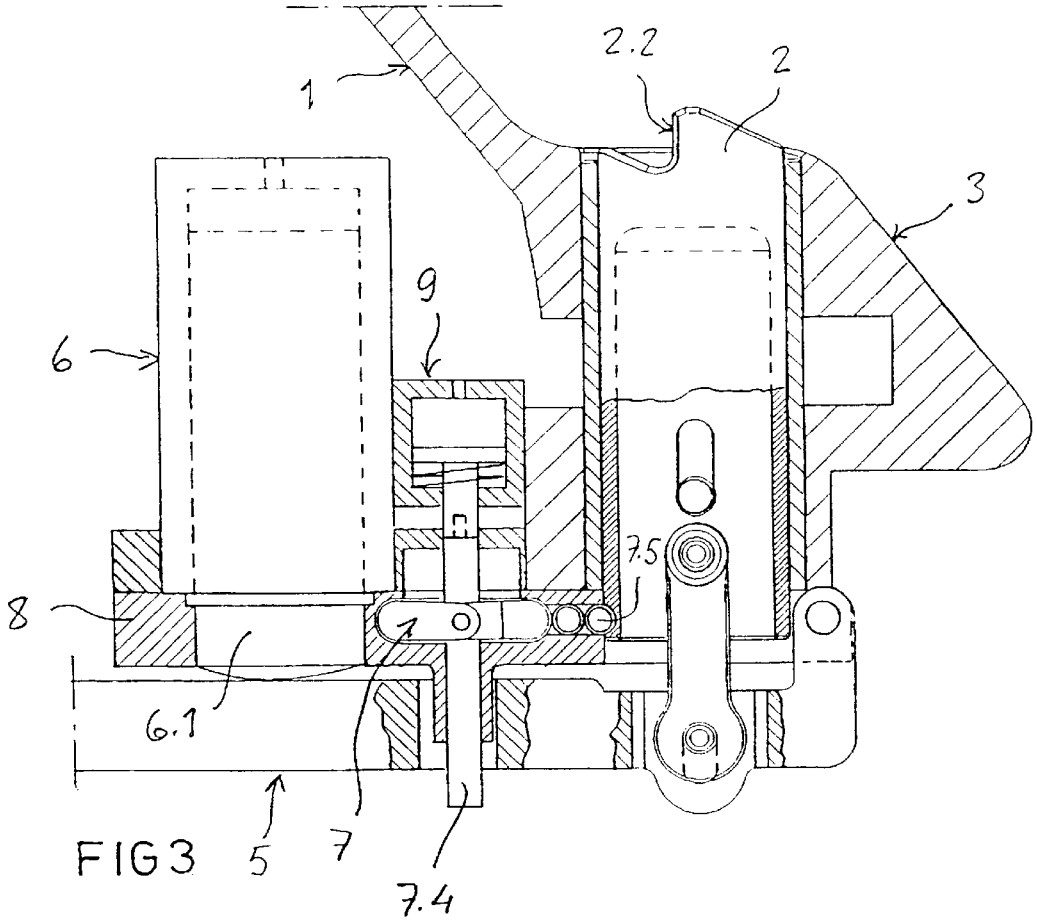
FIG. 3 shows the coupling parts in accordance with FIG. 2 in locked position
Figure 5:
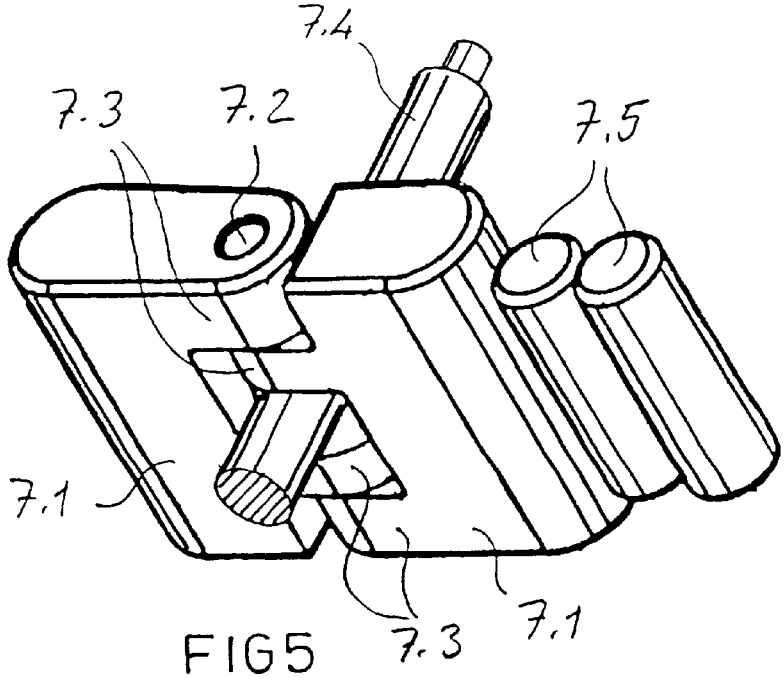
FIG. 5 shows the locking link on its own, in the position shown in FIG. 3.

The plunger 2 has a recess 2.6 in the shape of a partial cylinder, in which the outer of the locking rollers 7.5 is displaced half way at the locking movement which consists of the actuating rod 7.4 being displaced from the position shown in FIGS. 2 and 4 to the position shown in FIGS. 3 and 5. In this position the locking links 7.1 completely fill the recess 7.6 in the housing 8. The locking movement is activated by a pneumatic operating cylinder 9 in which a piston 9.1 is movable and which is connected via a piston rod 9.2 to the actuating rod 7.4. When the operating cylinder 9 is placed under pressure by compressed air through the opening 9.3, the piston 9.1, with the piston rod 9.2, moves that actuating rod 7.4 from the position shown in FIG. 2 to the position shown in FIG. 3. Pressurising takes place after connection of the two coupling heads has been completed and the plunger 2 moved to its outer position.

When two coupling heads are disengaged, the air pressure in the operating cylinder decreases to the ambient pressure, whereupon the piston 9.1 is pressed back to its initial position by means of a spring 9.4 arranged on the lower side of the piston 9.1, or by the space below the piston being placed under pressure. The piston rod 9.2 then pulls the actuating rod from the locked position occupied by the locking device 7 as shown in FIG. 3, to the disengaged positioned shown in FIG. 2. Disengagement of the locking device 7 can also be achieved by manually pressing in the end of the actuating rod 7.4 that protrudes from an opening in the disengaging lever 5. The actual uncoupling of the two co-operating plungers in each coupling head is achieved either by pressurising the disengaging cylinder 6, the piston 6.1 of which then turns the disengaging lever 5 outwards, or by manually pulling on the disengaging lever 5, in which case the actuating rod 7.4 may have to be pushed in first and the locking links 7.1 caused to fold so that the locking member 7.5 is released.

What is claimed is:

1. A coupling arrangement for coupling together rail vehicles such as railway carriages and locomotives, consisting of a coupling head comprising a coupling housing joined to the rail vehicle and having an active coupling device in the form of a plunger movable between an outer and an inner position and designed to cooperate with a similar plunger in a corresponding coupling head when two coupling heads are coupled together, the plungers being movable in directions that are substantially perpendicular to the longitudinal directions of the coupling heads and can be moved away from each other by mutual contact at interlocking, and with the aid of a disengaging means influencing respective plungers at uncoupling, and a locking device in the coupling arrangement which comprises a locking member arranged to be brought into direct contact with the plunger when said plunger is in said outer position and to prevent the plunger being displaced from said outer position.

2. A coupling arrangement as claimed in claim 1, wherein the locking arrangement includes a toggle joint comprising two locking links which are hingeably joined and placed in a locking housing and which, when the plunger is in locked position, are arranged in one and the same plane and to transmit a force between the locking member and the locking housing and which, when the plunger is to be released, are folded about a hinge so that the locking member can be disengaged from the plunger, thereby releasing the latter.

3. A coupling arrangement as claimed in claim 1, wherein the locking arrangement includes a linearly movable wedge which is in connection with the locking member and which, when the plunger is in locked position, keeps the locking member pressed against the plunger and which, when the plunger is to be released, is disengaged from the plunger.

4. A coupling arrangement as claimed in claim 2 or claim 3, wherein the locking member consists of a roller which, upon locking, is displaced directly or indirectly at a right angle to a longitudinal direction of the roller in a channel in the locking housing in a direction towards the plunger to engage with a corresponding recess in outer shell of the plunger.

5. A coupling arrangement as claimed in claim 4, including an actuating rod which extends through the locking arrangement and is in communication with locking links or wedge, and wherein one end of the actuating rod is connected to a piston in an operating cylinder which, when pressurised by means of a hydraulic pneumatic pressure medium, causes the locking links or the wedge to press the locking member to engagement with the plunger.

6. A coupling arrangement as claimed in claim 5, including a return spring located on a non-pressurised side of the piston, enabling the actuating rod to be pulled back to its original position, thereby releasing the locking member when the pressure in the pressure medium ceases.

7. A coupling arrangement as claimed in claim 5, wherein a hydraulic or pneumatic pressure medium is transferred from one to another side of the piston, thus enabling the actuating rod to be pulled back to its initial position and release the locking member.

8. A coupling arrangement as claimed in claim 7, wherein the other end of the actuating rod protrudes from the housing and indicates whether the locking arrangement is in locked or released position, and actuating rod can be pushed in manually and release the locking member.

* * * * *